United States Patent [19]

Herbst

[11] 4,184,500

[45] Jan. 22, 1980

[54] DISHWASHER VENT CLOSING ARRANGEMENT

[75] Inventor: LeRoy J. Herbst, Louisville, Ky.

[73] Assignee: General Electric Company, Louisville, Ky.

[21] Appl. No.: 929,462

[22] Filed: Jul. 31, 1978

[51] Int. Cl.[2] ..... B08B 3/00

[52] U.S. Cl. ..... 134/114; 134/182; 134/200; 137/251

[58] Field of Search ..... 134/114, 154, 182, 183, 134/201, 200, 56 D, 57 D, 57 DL, 58 D, 58 DL, 25 A, 25 R, 29, 42; 137/253, 251, 254; 261/1; 98/30

[56] References Cited

U.S. PATENT DOCUMENTS

| | | | |
|---|---|---|---|
| 68,076 | 9/1867 | Hoffman | 98/30 |
| 1,591,893 | 7/1926 | Tappen | 137/253 |
| 3,807,420 | 4/1974 | Donselman et al. | 134/114 |

*Primary Examiner*—S. Leon Bashore

*Assistant Examiner*—Michael Goldman

*Attorney, Agent, or Firm*—H. Neil Houser; Radford M. Reams

[57] ABSTRACT

An arrangement for controlling communication of a dishwasher vent opening to allow escape of the humid air from the interior of the dishwasher cabinet during the drying cycle, while sealing the opening during the wash and rinse cycles, including a vertically aligned series of ribs mounted within the opening. Each rib is trough-shaped to provide a liquid retention channel and the bottom of each rib is positioned within the next succeeding rib such that upon each channel being filled with water, a water seal of the opening is achieved. Alternate ends of each rib are open to create a cascade flow draining of the water through the rib series. The water level is maintained by being continuously replenished during the wash and rinse cycles to maintain the water seal. At the end of the rinse cycle, the water drains from the liquid retention channels to enable venting of the interior air through the ribs.

5 Claims, 3 Drawing Figures

DISHWASHER VENT CLOSING ARRANGEMENT

BACKGROUND DISCUSSION

This invention concerns dishwashers and more particularly closure arrangements for dishwasher vent openings. Such openings are provided to enable escape of the relatively hot humid air within the interior of the dishwasher cabinet during the drying cycle such that drying may be facilitated. Since the escape of humid air and dishwasher noise during the wash and rinse cycles should be avoided, dishwashers incorporating such vent openings typically have incorporated some arrangement for closure of the vent openings during the wash and rinse cycles.

The conventional approach is to provide a flapper valve mechanically operated by means of a timer-controlled solenoid or a similar control arrangement. Such components are subject to wear and failure and thus increase the manufacturing cost and maintenance requirements of such dishwashers.

In U.S. Pat. No. 2,909,184, there is described a vent closure arrangement in which does not require such moving parts and controls. In this arrangement, a horizontally disposed retaining pan is provided into which extends a flanged water inlet opening, which opening establishes communication in between the cabinet interior space and the exterior vent opening. This retaining pan is positioned with respect to the end of the flange such that when the retaining pan is filled with water, a water seal of the vent is created. Water is maintained in the retaining pan during filling, wash and rinse cycles, but is allowed to drain away during the drying cycle through a drain hole located in the bottom of the retaining pan. While this achieves the desired objective of eliminating moving parts and the necessary controls, the particular configuration of the vent opening between the flange and the retaining pan substantially retards vent air flow.

The relationship between the vent flow and the configuration of the vent opening may be critical in those designs relying on convection currents to set up the proper air flow within the cabinet and the air flow itself must be carefully controlled in order to achieve an efficient drying process, requiring the minimum amounts of drying heat.

Accordingly, it is an object of the present invention to provide a vent closure arrangement and method for dishwasher vent openings which does not involve the use of moving parts or controls therefor, but in the open condition, the vent opening does not significantly retard the flow of vented air from the dishwasher interior.

It is a further object of the present invention to provide such an arrangement which incorporates relatively simple components which may be manufactured at relatively low cost.

SUMMARY OF THE INVENTION

These and other objects of the present invention, which will become apparent upon a reading of the following specification and claims, are achieved by an arrangement consisting of a series of vertical ribs extending laterally across the vent opening. The ribs are trough-shaped to create liquid retention channels, with the bottom of each trough extending downwardly to a point within the liquid retention channel of the next below succeeding rib, such that whenever the channels are filled with liquid, a water seal of the opening is achieved. Drain means are provided to allow the liquid to be removed from the liquid retention channels and the opening unsealed.

Water fills each liquid retention channel during the wash and rinse cycles by overspray from the wash and rinse water sprays directed at the dishware items. A cascade drain flow is provided in which water is drained from each rib to the next below succeeding rib by having alternate ends of successive ribs open at one end thereof, such that upon cessation of the wash and rinse cycles, the water is emptied from the liquid retention channels to open the water seal and allow the free passage of air vent currents to pass out between the ribs.

The rib series is provided by a pair of interfitted molded plastic components, each formed with offset alternate series of ribs. The molded plastic rib components in turn are assembled into a molded frame element which secures the rib series in position in an opening formed in the dishwasher door liner.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
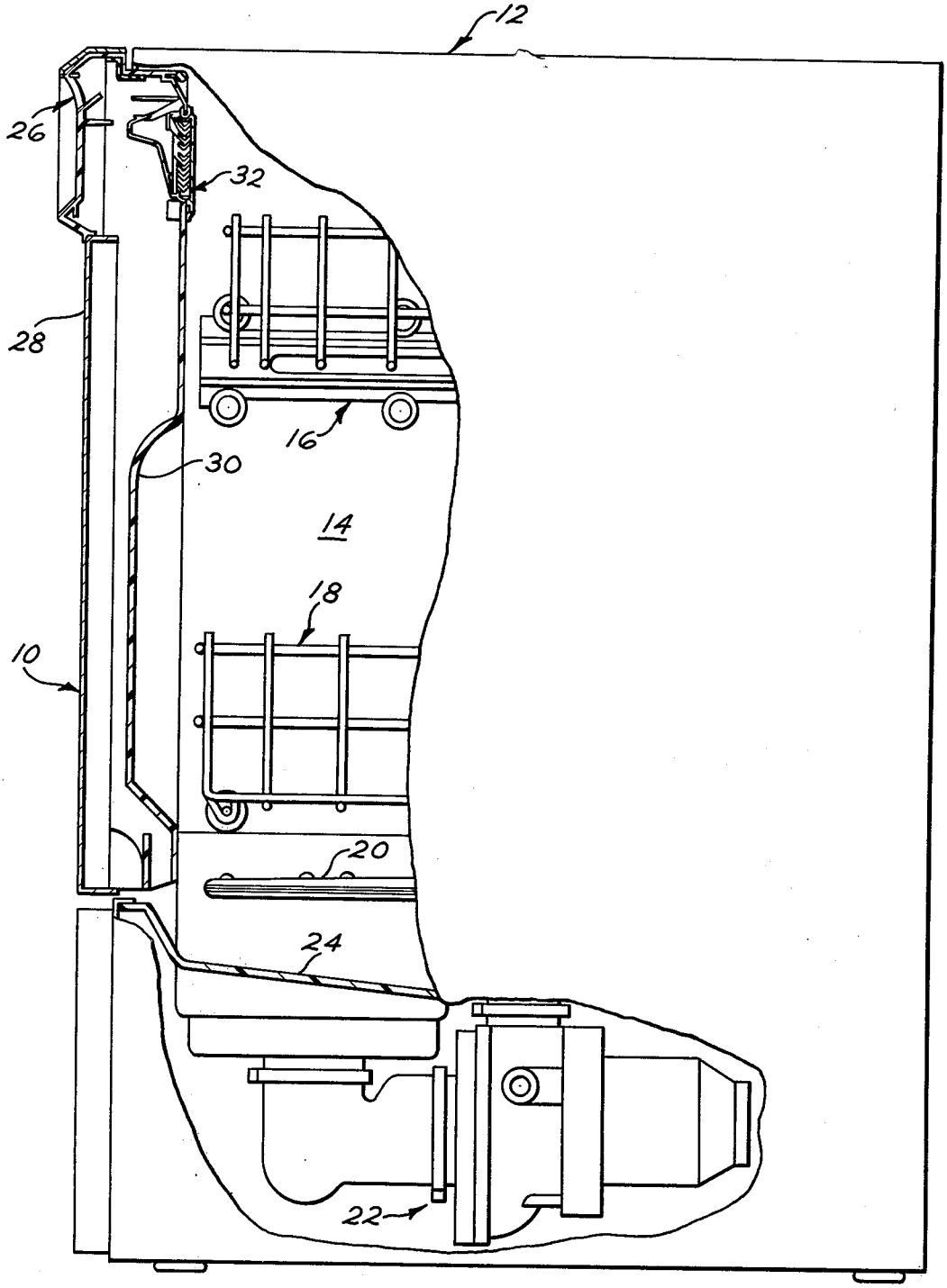
FIG. 1 is a side elevational view of the dishwasher, with the exterior cabinet panels partially broken away and the frontal access door in partial section, depicting the vent closure arrangement according to the present invention.

Referring to the drawings, FIG. 1 depicts a dishwasher 10 incorporating the invention. Dishwasher 10 includes an outer cabinet 12 constructed of formed metal panels. Within the outer cabinet 12 is an interior cabinet space 14 formed by inner liner panels and within which is located the upper dishrack 16 and lower dishrack 18, adapted to position the dishware items for washing and rinsing.

A rotary spray nozzle 20 provides means for directing a high pressure spray of wash and rinse water throughout the interior cabinet space 14, such as to execute the cleaning of the dishware items. The water under pressure is supplied by a pump unit 22 which receives water collected in a bottom rub 24 and recirculates the same through rotary spray nozzle 20 during the wash and rinse cycles in the conventional fashion.

During the drying cycle, the warm humid air contained within the interior cabinet space 14 is allowed to be vented to the exterior of the outer cabinet 12 through a vent opening 26 formed in the outer panel of the front mounted access door 28. The access door 28 is provided with an inner door panel liner 30, also provided with a corresponding vent opening 32, allowing the interior air to pass out through the panel liner 30 and thence to the vent opening 26.

Figure 2:
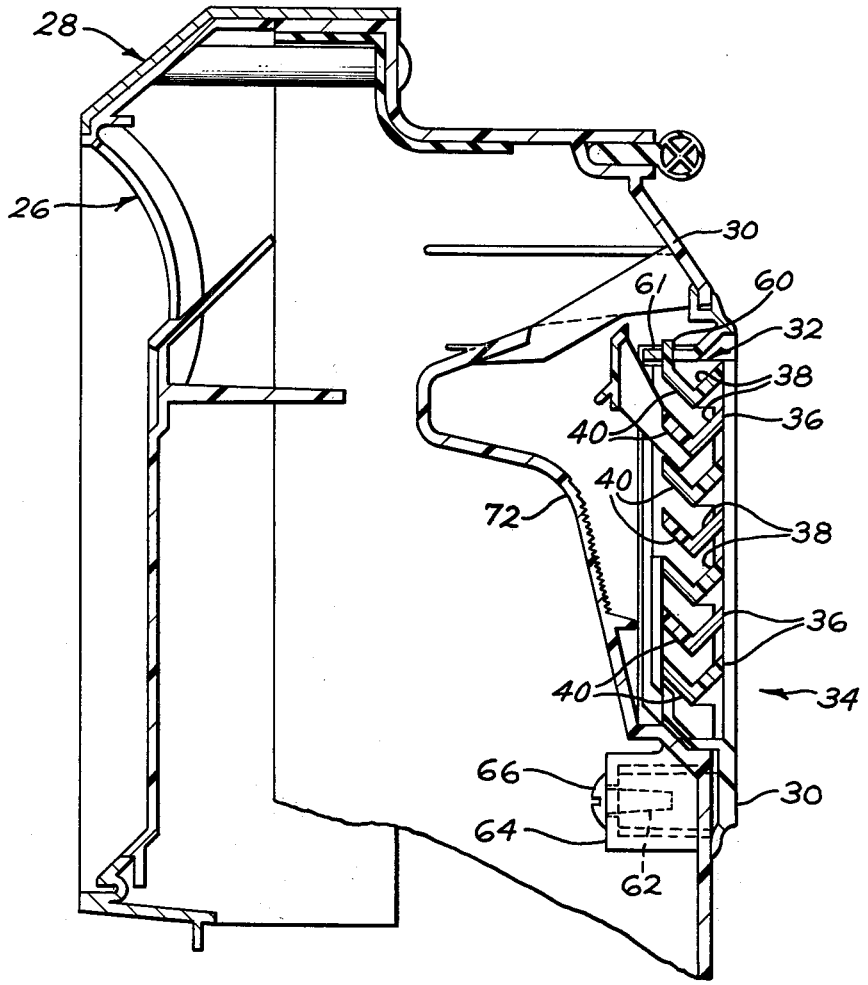
FIG. 2 is an enlarged sectional view of the upper portion of the frontal access door shown in FIG. 1, depicting the details of the vent closure arrangement according to the present invention.

The vent opening 32 is controllably sealed and opened by the closure arrangement and method according to the present invention, the details of which are depicted in FIG. 2.

The closure arrangement 34 includes a vertically disposed series of ribs 36 which extend laterally across the vent opening 32. Each of the ribs 36 is Vee or trough-shaped such as to define liquid retention channels 38 on the upper side of each rib 36. The relationship of the ribs 36 in the vertical series is such that the bottommost edge 40 of each rib 36 extends to or below the level of the liquid retention channels 38 defined in the next succeeding lower rib in the vertical series.

The disposition of the ribs 36 adjacent the interior cabinet space 14 insures that means are provided for continuously filling the liquid retention channels 38 during the wash and rinse cycles by the collection of overspray within the interior cabinet space 14.

When each of the liquid retention channels 38 is filled with liquid, the disposition of the bottommost edge 40 creates a liquid seal of the vent opening 32 in cooperation with the liquid disclosed in the liquid retention channels 38.

Drain means are also provided for controllably emptying each of the liquid retention channels 38. This drain means creates a continuous draining of each of the liquid retention channels 38, such that upon termination of the wash and rinse cycles, the liquid contained therein is not replenished, such that continuous draining provides a means for emptying the liquid retention channels 38 into the interior of the dishwasher cabinet to thereby unseal the openings 32, establishing communication through the space in the inner door wall to the vent opening 26.

The openings between the ribs 36 in the absence of liquid creates only a nominal resistance to the convection flow, and the trailing half of the "Vee" section of each rib 36 provides upward direction to the vent flow to aid the movement of the moisture laden air moving through the vent opening 32.

The drain means for each rib 36, including the lowermost rib, is located at the opposite end from each succeeding and preceding rib in the vertical series, such as to create a cascade flow, in series through the liquid retention channels 38 to minimize the quantity of water which needs to be collected in the liquid retention channels 38 in order to maintain the sealing of the opening.

Figure 3:
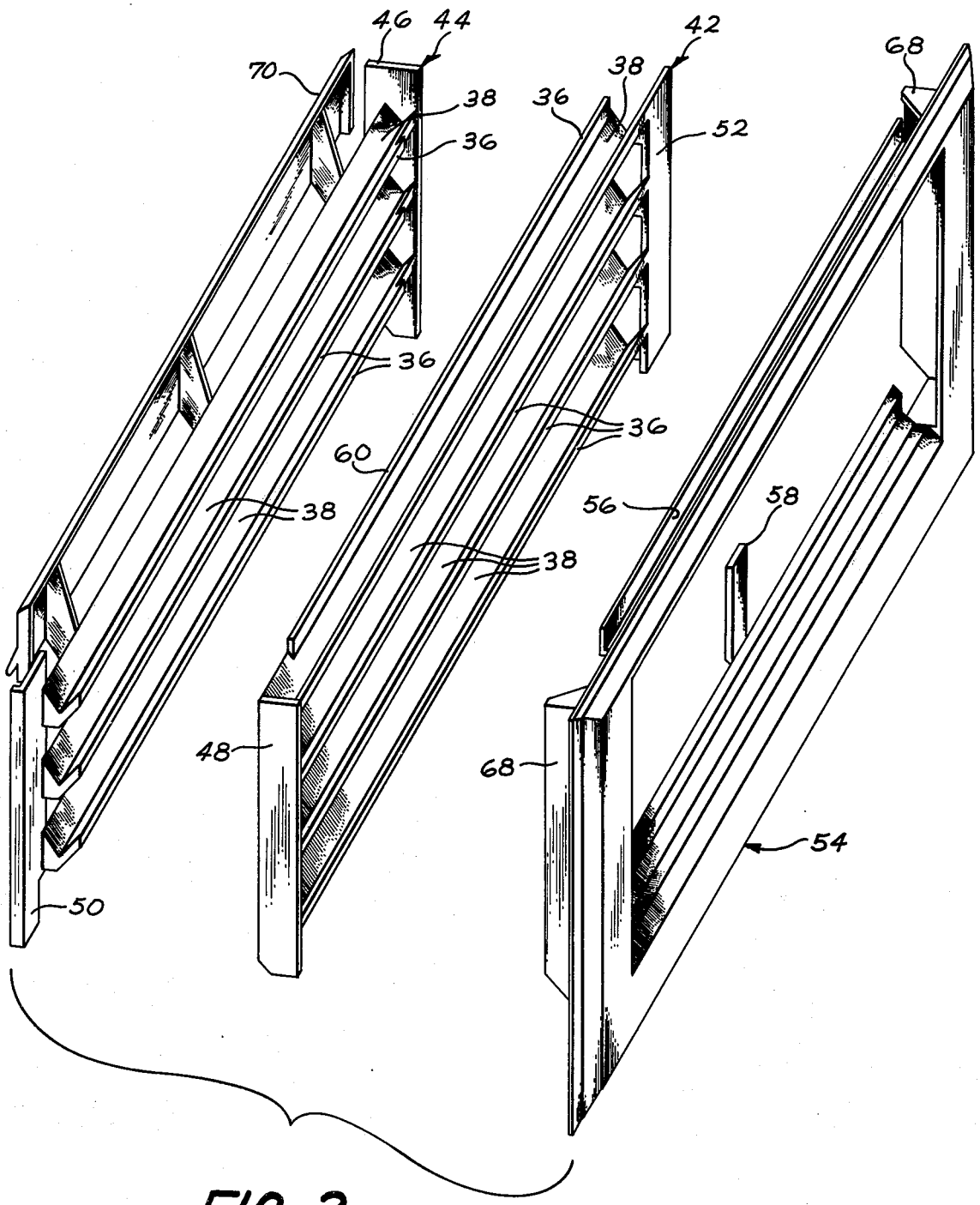
FIG. 3 is an exploded perspective view of the molded components comprising the vent closure arrangement according to the present invention.

This can be seen from an inspection of FIG. 3 which depicts the three-piece assembly which provides the mounting of the ribs 36 within the vent opening 32.

Specifically, the components comprise molded plastic parts with a pair of interfitted first and second rib parts 42 and 44. Each rib part 42 and 44 is provided with alternate ribs 36 in the vertical series, such that upon nesting together of the respective parts an aligned vertical series is established. The open end of the ribs 36 of the respective rib parts 42 and 44 are offset from those in the other series to create the cascade drain flow described.

This is achieved by an integrally molded endpiece 46 on rib part 44 and endpiece 48 formed on the opposite side of rib part 42, which thereby blocks successive alternate ends of the liquid retention channels 38 in the vertical series of ribs 36.

The opposite side of rib part 44 is formed with an integral bar 50 positioned with respect to the ribs 36 such as to provide an open end thereof. Similarly, rib part 42 is provided with a molded end bar 52 so as to provide a drain opening consisting of the open end of each rib including the lowermost rib. Thus, a cascade drain flow will be achieved by draining from the open end of each rib, down the length of the liquid retention channel 38 of the next below succeeding rib to its open end and thence back to the open end of the lower succeeding rib, and so forth. Upon reaching the lowermost rib of the series, the water drains from the open end thereof into the interior of the dishwasher cabinet. This minimizes the quantity of liquid flow required in order to maintain the liquid retention channels 38 in the full condition, while insuring that the drain means will completely empty the liquid retention channels 38 upon termination of the wash and rinse cycles.

Rib parts 42 and 44 are adapted to be nested into a molded plastic frame member 54 which has an end channel 56 adapted to be nested within the edge of the inner door panel liner 30 and mount the rib assemblies within the vent opening 32.

A retaining tab 58 captures the lower three ribs in the series, while an upper tab 60 formed in the rib part 42 is received within the upper frame wall 61 of the frame member 54, to assemble therein parts 42 and 44 to the frame member 54. The frame member 54 is provided with a pair of bosses 62 which are adapted to receive a threaded fastener 64 received within a socket 66 and retained therein. A pair of guides 68 are provided on the frame member 54 for positioning the rib sections 42 and 44. Splash guard 70 integrally molded with the rib part 44 and tab 60 serves to supplement a main splash guard 72 (FIG. 2) formed to the rear of the vent opening 32, all serving to prevent splash out during initial operation of the wash and rinse cycles. Accordingly, it can be seen that a closure arrangement and method have been provided in which the need for any controls or mechanically actuated parts are eliminated since the filling and emptying of the liquid retention channels automatically occur at the appropriate times during the dishwasher cycling for the sealing and opening of the vent to provide a low cost, failsafe, and maintenance free operation.

The specific configuration of the vertically aligned series of ribs is provided by low cost molded plastic parts which are interfit together to eliminate the need for fasteners such that the manufacturing costs involved are minimal. In addition, the cascade flow arrangement to the drain in which the liquid in the liquid retention channels 38 drain sequentially in a cascade through a series of ribs is such that the quantity of liquid required to be collected by the ribs is greatly reduced.

The closure arrangement, while having very advantageous application to dishwasher vents, may also be applied to other structures having openings to be controllably sealed and opened.

The embodiments of the invention in which an exclusive property or privilege is claimed are defined as follows:

1. A closure arrangement for controllably sealing an opening formed in a structure, comprising:

a vertically spaced series of ribs mounted extending laterally across said opening, each of said ribs being trough-shaped to define a liquid retention channel extending along the length of each rib, with the lowermost portion of each rib extending to or below the upper level of said liquid retention channel defined by the next succeeding lower rib in said vertical series;

means for continuously adding liquid into each of said liquid retention channels;

drain means formed in each rib for continuously draining each of said liquid retention channels of liquid so as to tend to empty said liquid retention channels, said rate of drain being less than said rate of adding liquid so as to establish a liquid seal whenever said liquid is being added to said liquid retention channels, whereby said opening may be controllably sealed and opened by the filling and emptying of said liquid retention channels;

each of said rib drain means being located at one end of each rib, said drain means of each rib in said vertical series being located at the opposite end from said drain means of the next preceding and succeeding rib, respectively, whereby a cascade drain flow through said rib series is achieved.

2. The closure arrangement according to claim 1 wherein alternate ribs in said series of ribs are integrally formed in separate pieces, said pieces being configured to mate together to dispose the ribs of the respective pieces into said vertical series.

3. In a dishwasher of the type including a dishwasher cabinet having an interior space therein, means for mounting dishware items in said interior space and means for directing wash and rinse water sprays at said dishware items mounted therein, means for drying said dishware items by heating the interior space of said dishwasher cabinet and a vent opening formed in said cabinet establishing communication of the interior of said cabinet with the exterior of said dishwasher cabinet, in combination, a vent closure arrangement comprising:

a vertically spaced series of laterally extending ribs mounted in said opening, each of said ribs being trough-shaped to define a liquid retention channel extending along the length of each rib with the lower portion of each rib extending to or below the uppermost level of said liquid retention channel defined by the next succeeding lower rib in said series;

means for controllably filling each of said liquid retention channels with said wash and rinse water during said wash and rinse cycles including means disposing said ribs so as to be filled with water overspray during wash and rinse cycles;

means for controllably emptying each of said liquid retention channels of wash water upon termination of said wash and rinse cycles including means continuously draining said liquid retention channels, whereby upon termination of said wash and rinse cycles, said liquid retention channels are emptied by the continuous draining thereof and replenished by said wash and rinse water overspray to thereby control communication of the interior of said dishwasher cabinet space with the exterior thereof during said wash and rinse cycles;

whereby said vent opening is sealed during said wash and rinse cycles by water disposed in said liquid retention channels and said vent opening to allow venting of the interior of said dishwasher cabinet after termination of said wash and rinse cycles by the emptying of said wash and rinse water from said liquid retention channels.

4. The dishwasher according to claim 3 wherein said means for continuously draining said liquid retention channels comprises drain means formed in each rib allowing draining of the liquid retention channels into the next succeeding lower liquid retention channel and draining of the lowermost liquid retention channel back into the interior of said dishwasher cabinet.

5. The dishwasher according to claim 4 wherein each of said rib drain means comprises an open end of each of said ribs of the successive ribs in the vertical series of ribs, each open end located at the opposite end from the open end of the next preceding and succeeding rib, whereby cascade drain flow through said open ends of each of said ribs in said rib series is achieved to thereby reduce the quantity of water which must be added to said liquid retention channels to fill each of said liquid retention channels.

* * * * *

Disclaimer 4,184,500.—*Leroy J. Herbst,* Louisville, Ky. DISHWASHER VENT CLOSING ARRANGEMENT. Patent dated Jan. 22, 1980. Disclaimer filed Nov. 18, 1981, by the assignee, *General Electric Co.*

Hereby enters this disclaimer to claims 1, 2, 3, 4 and 5 of said patent.

[*Official Gazette February 16, 1982.*]